US007814874B2

(12) United States Patent
Kubani et al.

(10) Patent No.: US 7,814,874 B2
(45) Date of Patent: Oct. 19, 2010

(54) CONTROLLING TWO CAM PHASERS WITH ONE CAM POSITION SENSOR

(75) Inventors: Ronald J. Kubani, Highland, MI (US); Coburn C. Bland, Jr., Holly, MI (US); Anthony L. Marks, Novi, MI (US)

(73) Assignee: GM Global Technology Operations, Inc.

( * ) Notice: Subject to any disclaimer, the term of this patent is extended or adjusted under 35 U.S.C. 154(b) by 0 days.

(21) Appl. No.: 11/728,332

(22) Filed: Mar. 23, 2007

(65) Prior Publication Data

US 2008/0230024 A1 Sep. 25, 2008

(51) Int. Cl.
*F01L 1/34* (2006.01)

(52) U.S. Cl. ..... 123/90.17; 123/90.15; 701/102

(58) Field of Classification Search ..... 123/90.17, 123/90.15, 90.16, 90.18, 90.27, 90.31, 612, 123/617; 324/379; 701/102, 115; 464/1, 464/2, 160

See application file for complete search history.

(56) References Cited

U.S. PATENT DOCUMENTS 5,469,823 A 11/1995 Ott et al.
5,715,780 A 2/1998 Haller
5,934,263 A 8/1999 Russ et al.
6,343,580 B2 * 2/2002 Uchida ..... 123/90.17
6,474,278 B1 11/2002 Davis et al.
6,481,270 B1 * 11/2002 Kobayashi et al. ..... 73/114.26
6,609,498 B2 8/2003 Mathews et al.
6,837,231 B1 1/2005 Herrin
6,895,751 B1 * 5/2005 Greentree ..... 60/602
6,899,093 B2 5/2005 Center
6,901,895 B2 * 6/2005 Mae et al. ..... 123/90.31
6,915,767 B2 7/2005 Pfeiffer et al.
7,021,281 B2 4/2006 Ruiz
7,058,500 B2 * 6/2006 Meyer et al. ..... 701/102
7,080,616 B2 * 7/2006 Nakamura et al. ..... 123/90.27
2007/0215079 A1 * 9/2007 Boggess et al. ..... 123/90.15
2007/0277753 A1 * 12/2007 Boggess et al. ..... 123/90.6

FOREIGN PATENT DOCUMENTS

DE 19810369 C1 * 8/1999
EP 1630393 3/2006
JP 10184406 A * 7/1998
JP 2003293709 A * 10/2003

* cited by examiner

*Primary Examiner*—Ching Chang

(57) ABSTRACT

A camshaft (cam) phaser control system for an engine includes a first camshaft having a first target wheel. A second camshaft has a second target wheel. A cam position sensor detects said first and second target wheels and generates camshaft position data based on said first and second target wheels.

20 Claims, 6 Drawing Sheets

CONTROLLING TWO CAM PHASERS WITH ONE CAM POSITION SENSOR

FIELD

The present invention relates to engine control and, more particularly, to camshaft position detection.

BACKGROUND

A camshaft actuates intake and exhaust valves of an internal combustion engine. In a dual overhead camshaft configuration, the engine includes an exhaust camshaft and an intake camshaft for each bank of cylinders. Rotation of the camshafts actuates the intake and exhaust valves. Position and timing between a crankshaft and the camshaft is critical for proper synchronization of spark and fuel.

An engine control system may include one or more camshaft phasing devices (cam phasers). For example, the cam phaser may create a continuously variable rotational offset between the exhaust camshaft and the intake camshaft and/or the crankshaft. Typically, cam phasers receive position and timing information from camshaft position sensors. The camshaft position sensor typically includes a variable reluctance or Hall Effect sensor that senses the passage of a tooth, tab, and/or slot on a target data wheel coupled to the camshaft.

The position sensor sends a signal to a control module. The control module develops an offset signal to control the cam phasers coupled to the camshafts. For example, the control module may be an engine control module. Alternatively, the control module may be a stand-alone controller or combined with other onboard controllers. The control module includes a processor and memory such as random access memory (RAM), read only memory (ROM) or other suitable electronic storage. Conventionally, internal combustion engines include one cam position sensor for each cam phaser. For example, in a dual-overhead cam arrangement, two cam position sensors are required to control the two cam phasers.

SUMMARY

A camshaft (cam) phaser control system for an engine includes a first camshaft having a first target wheel. A second camshaft has a second target wheel. A cam position sensor detects said first and second target wheels and generates camshaft position data based on said first and second target wheels.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
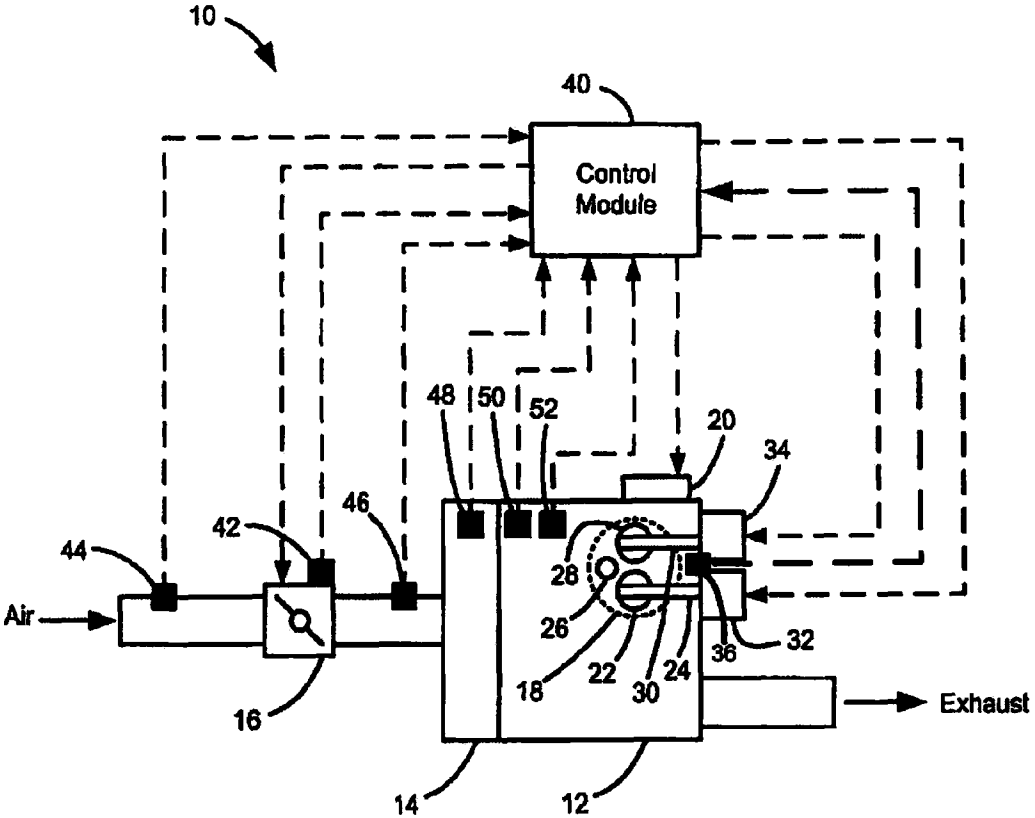
FIG. 1 is a functional block diagram of a vehicle including a cam phaser control system according to the present disclosure.

The following description is merely exemplary in nature and is not intended to limit the present disclosure, application, or uses. As used herein, the term module refers to an application specific integrated circuit (ASIC), an electronic circuit, a processor (shared, dedicated, or group) and memory that execute one or more software or firmware programs, a combinational logic circuit, or any other suitable components that provide the described functionality. For purposes of clarity, the same reference numbers will be used in the drawings to identify similar elements.

Referring now to FIG. 1, an engine system 10 includes an engine 12 that implements a cam phaser control system of the present disclosure. Air is drawn into an intake manifold 14 through a throttle 16. The throttle 16 regulates mass air flow into the intake manifold 14. Air within the intake manifold 14 is distributed into cylinders 18. Although a single cylinder 18 is illustrated, it is appreciated that a camshaft phaser control system of the present invention can be implemented in engines having a plurality of cylinders including, but not limited to 2, 3, 4, 5, 6, 8, 10 and 12 cylinders.

An intake valve 22 selectively opens and closes to enable the air/fuel mixture to enter the cylinder 18. The intake valve position is regulated by an intake camshaft 24. A piston (not shown) compresses the air/fuel mixture within the cylinder 18. A spark plug 26 initiates combustion of the air/fuel mixture, driving the piston in the cylinder 18. The piston drives a crankshaft (not shown) to produce drive torque. Combustion exhaust within the cylinder 18 is forced out an exhaust port when an exhaust valve 28 is in an open position. The exhaust valve position is regulated by an exhaust camshaft 30. The exhaust is treated in an exhaust system and is released to the atmosphere. Although single intake and exhaust valves 22, 28 are illustrated, it is appreciated that the engine 12 can include multiple intake and exhaust valves 22, 28 per cylinder 18.

The engine system 10 further includes an intake camshaft (cam) phaser 32 and an exhaust cam phaser 34 that respectively regulate the rotational timing and/or lift of the intake and exhaust camshafts 24, 30. More specifically, the timing of the intake and exhaust camshafts 24, 30 can be retarded or advanced with respect to each other or with respect to a location of the piston within the cylinder 18 or crankshaft position. The intake cam phaser 32 and the exhaust cam phaser 34 regulate the intake and exhaust cam shafts 24, 30 based on signals output from a cam position sensor 36. The cam position sensor 36 can include, but is not limited to, a variable reluctance or Hall Effect sensor. The cam position sensor 36 transmits output signals indicating rotational position of the intake or exhaust camshafts 24, 30 when the cam position sensor 36 senses the passage of a spaced position marker (e.g. tooth, tab, and/or slot) on a disc or target wheel (not shown) coupled to the intake or exhaust camshafts 24, 30.

A control module 40 operates the engine based on the engine cam phaser control system of the present invention. The control module 40 generates control signals to regulate engine components in response to engine operating conditions. The control module 40 generates a throttle control signal based on a position of an accelerator pedal (not shown)

and a throttle position signal generated by a throttle position sensor (TPS) 42. A throttle actuator adjusts the throttle position based on the throttle control signal. The throttle actuator can include a motor or a stepper motor, which provides limited and/or coarse control of the throttle position. The control module 40 also regulates the fuel injection system 20 and the cam shaft phasers 32, 34. The control module 40 determines the positioning and timing (e.g. phase) between the intake or exhaust camshafts 24, 30 and the crankshaft based on the output of the cam position sensor 36 and other sensors.

An intake air temperature (IAT) sensor 44 is responsive to a temperature of the intake air flow and generates an intake air temperature signal. A mass airflow (MAF) sensor 46 is responsive to the mass of the intake air flow and generates a MAF signal. A manifold absolute pressure (MAP) sensor 48 is responsive to the pressure within the intake manifold 14 and generates a MAP signal. An engine coolant temperature sensor 50 is responsive to a coolant temperature and generates an engine temperature signal. An engine speed sensor 52 is responsive to a rotational speed of the engine 12 and generates an engine speed signal. Each of the signals generated by the sensors is received by the control module 40.

Figure 2:
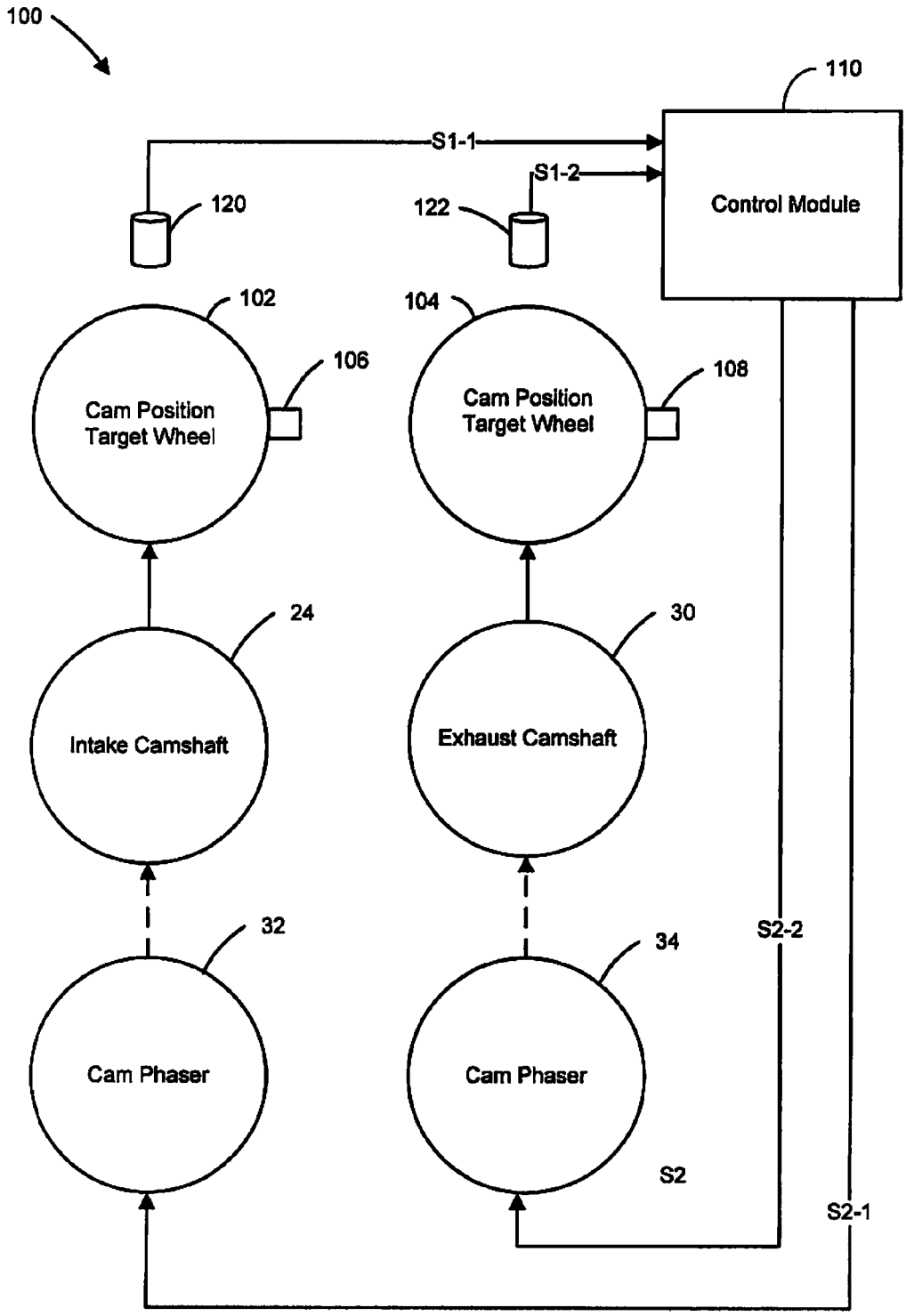
FIG. 2 (Prior Art)
FIG. 2 illustrates a cam phaser control system according to the prior art.

Referring now to FIG. 2, a conventional cam phaser control system 100 is shown. Cam position target wheels 102, 104 rotate in phase with the camshafts 24, 30, respectively. Cam position sensors 120, 122 are positioned to detect the cam position target wheels 102, 104, respectively. The cam position sensors 120, 122, respectively generate output signals S1-1, S1-2 as spaced position markers (e.g. teeth) 106, 108 pass by the cam position sensors 120, 122, respectively. While the cam position target wheels 102, 104 are shown to include teeth 106, 108, other embodiments may use tabs and/or slots. The cam position sensors 120, 122 transmit the output signals S1-1, S1-2, respectively, to a control module 110. The control module 110 communicates offset signals S2-1, S2-2 to the cam phasers 32, 34, respectively, connected to camshafts 24, 30 to produce camshaft rotational offsets.

Figure 3A:
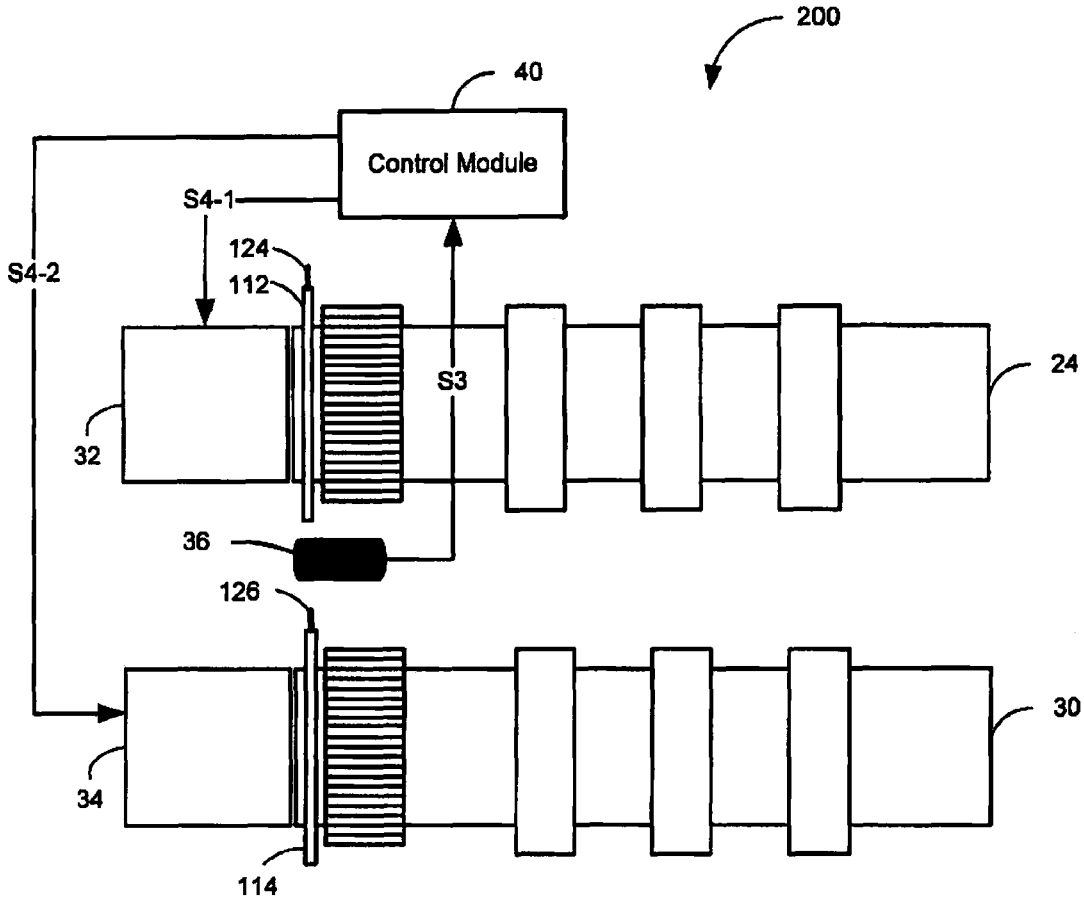
FIG. 3A is an exemplary embodiment of a cam phaser control system according to the present disclosure.

Referring now to FIG. 3A, a cam phaser control system 200 according to the present disclosure is shown. In the present implementation, a dual overhead cam system implements the camshaft phaser control system 200 although other system configurations are contemplated. The control system 200 includes a single cam position sensor 36 to sense variations in position and/or timing of the cam position target wheels 112, 114. The cam position target wheels 112, 114 rotate in phase with the intake camshaft 24 and the exhaust camshaft 30, respectively.

The cam position sensor 36 is located in a position to detect target wheel teeth 124, 126 on both of the target wheels 112, 114. The cam position sensor 36 transmits an output signal S3 to the control module 40 indicating that one of the teeth 124 or 126 has passed by the cam position sensor 36. The control module 40 generates offset signals S4-1 or S4-2 based in part on the output signal S3. The cam phasers 32, 34 rotationally offset the camshafts 24, 30 relative to the crankshaft based on receiving the offset signals S4-1, S4-2, respectively.

The present implementation includes the cam position sensor 36 positioned adjacent to both the cam position target wheels 112, 114. Several configurations are contemplated to achieve the positional relationship of cam position sensor 36 relative to the cam position target wheels 112, 114 including, but not limited to, positioning the camshafts 24, 30 in close proximity, increasing the diameter of the cam position target wheels 112, 114, and/or increasing the size of the cam position sensor 36. The cam position sensor 36 uses a magnetic field to generate the output signal S3. As the target wheel teeth 124, 126 of the cam position target wheels 112, 114 pass the cam position sensor 36, the target wheel teeth 124, 126 cause a disturbance in the magnetic field. The cam position sensor 36 generates the output signal S3 based on the disturbance in the magnetic field.

In various embodiments, the cam phaser control system may include a flux deflector (not shown). The flux deflector includes a magnetically conductive metal (e.g. steel) that redirects the magnetic field of the cam position sensor 36.

In various embodiments, each of the cam position target wheels 112, 114 may include a plurality of the target wheel teeth 124, 126, respectively. In the present implementation, the cam position sensor 36 detects a single tooth 124, 126 of one of the cam position target wheels 112, 114 at an instance in time. In the present implementation, positioning of the cam position target wheels 112, 114 allows for one of the target wheel teeth 124, 126 to be in a detectable proximity to the cam position sensor 36 at the instance in time. The cam position sensor 36 may be positioned to detect the cam position target wheels 112,114 in either the axial or radial direction.

Figure 3B:
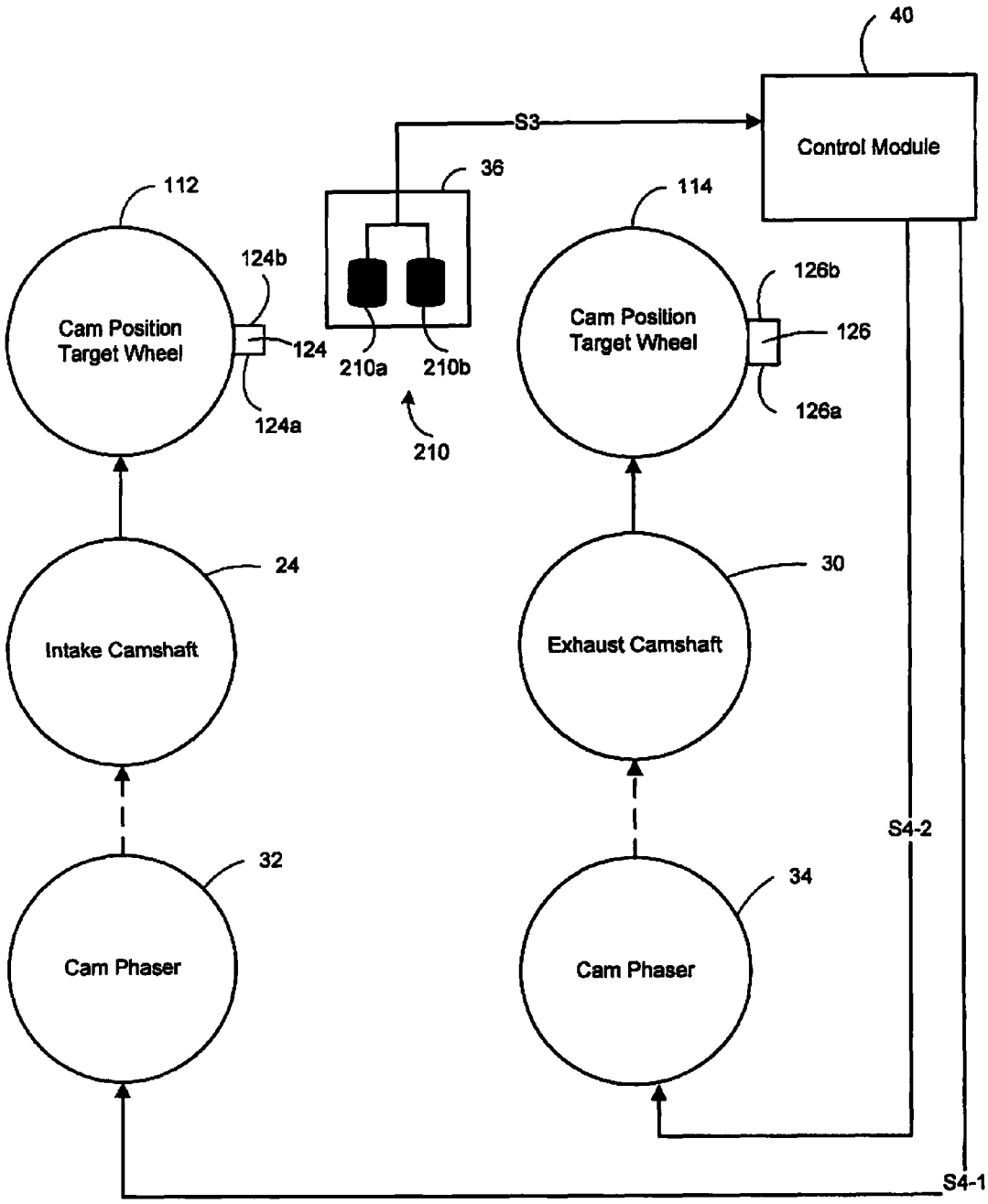
FIG. 3B is an exemplary embodiment of a cam phaser control system according to the present disclosure.

Referring now to FIG. 3B, in various embodiments, the cam phaser control system 200 may include a cam position module 36 that includes two position sensing elements 210*a*, 210*b*, referred to collectively as position sensing elements 210. Each of the position sensing elements 210 detects one of the cam position target wheels 112,114.

Figure 4A:
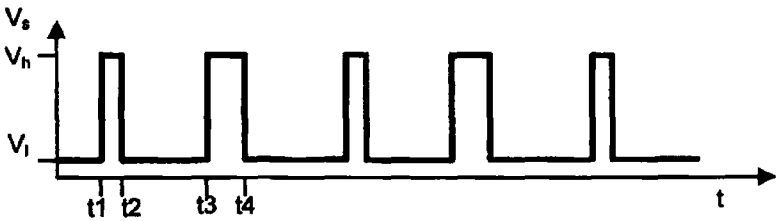
FIG. 4A is a timing diagram of the operation of the cam phaser control system according to the present disclosure.
Figure 4B:
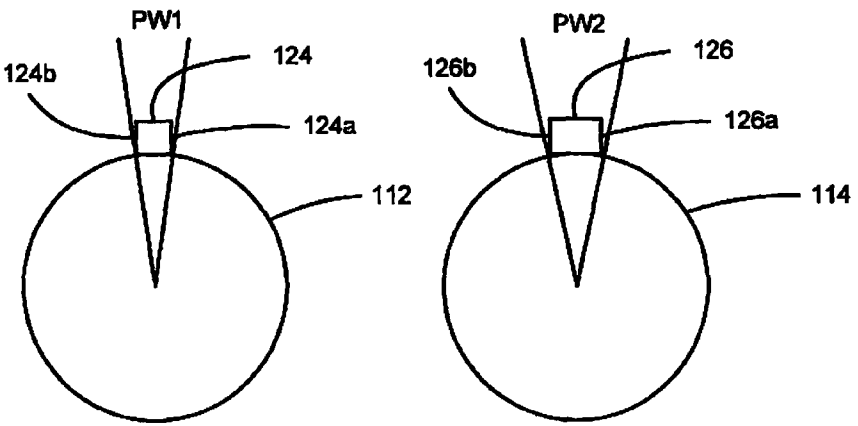
FIG. 4B illustrates a timing variation of a plurality of cam position target wheels according to the present disclosure.

Referring now to FIGS. 4A and 4B, the cam position target wheels 112, 114 and a timing diagram of the operation of the cam phaser control system according to the present disclosure are discussed in detail. An output signal $V_s$ generated by the cam position sensor 36 rises to a "high" voltage level ($V_h$), such as at time $t_1$, relative to a reference voltage (e.g. $V_{ref}$) when a leading edge 124*a* or 126*a* of one of the teeth 124 or 126, as depicted in FIG. 4B, is detected by the cam position sensor 36. The output signal $V_s$ remains high until a respective trailing edge 124*b*, 126*b* of one of the target teeth 124, 126 passes the cam position sensor 36 whereupon the output signal $V_s$ drops to a "low" voltage level ($V_h$), such as at time $t_2$.

In the present implementation, each of the cam position target wheels 112, 114 possess distinct teeth, tabs, and/or slots of various sizes. In other words, the intake cam position target wheel 112 possess target wheel teeth 124 that are sized differently than the target wheel teeth 126 of the exhaust cam position target wheel 114. Consequently, a pulse width corresponding to a difference between the time t1 and time t2 (e.g. PW1) varies from a pulse width corresponding to a difference between a time t3 and a time t4 (e.g. PW2). The PW1 and PW2 represent periods of time (i.e. detection periods) that the teeth 124, 126, respectively, are detected by the cam position sensor 36. The control module 40 can determine whether the cam position target wheel 112 or 114 has passed the position sensor 36 based on known values or PW1 or PW2, respectively. The control module 40 then generates optimum offset values for the cam phasers 32, 34 based on PW1, PW2, respectively.

In various embodiments, the control module 40 may determine whether the cam position target wheel 112 or 114 has passed the cam position sensor 36 by comparing a detection period to a time threshold. For example, if the detection period exceeds the time threshold, the control module 40 may determine that the cam position target wheel 114 passed the cam position sensor 36. However, if the detection period falls below the time threshold, the control module 40 may determine that the cam position target wheel 112 passed the cam position sensor 36.

Figure 5:
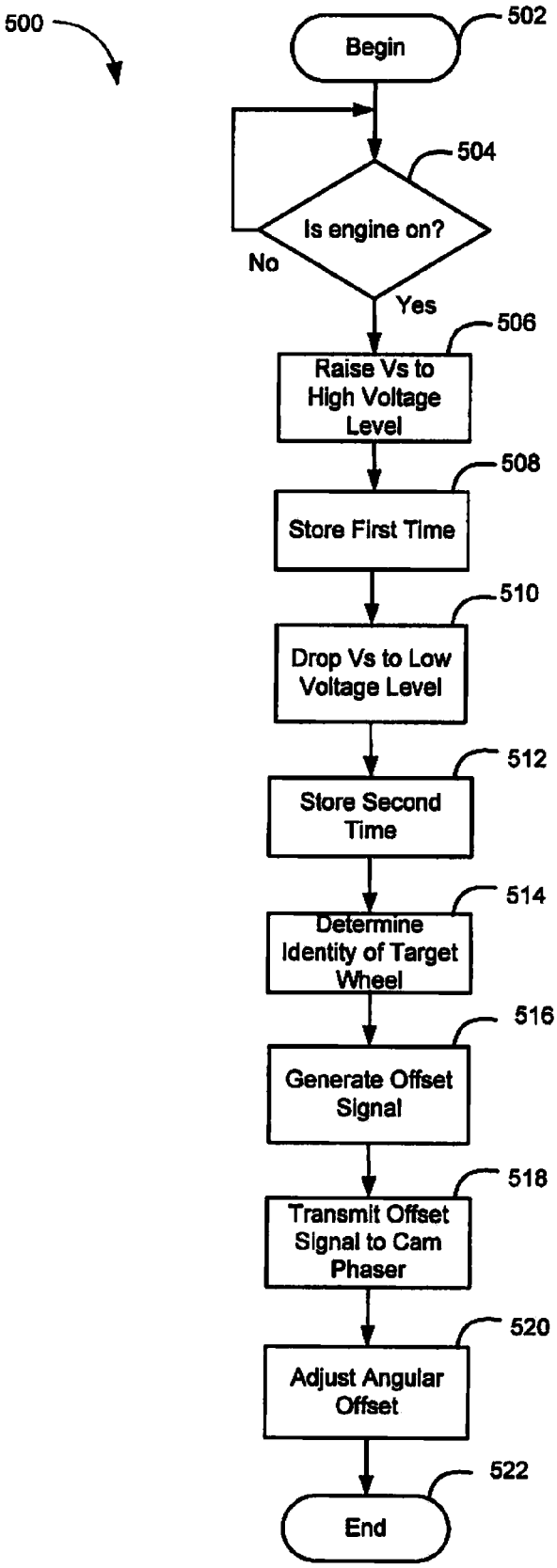
FIG. 5 is a flow diagram illustrating for operating the cam phaser control system according to the present disclosure.

Referring now to FIG. 5, a method 500 for operating a cam phaser control system is shown. The method 500 begins with step 502. In step 504, the control module 40 determines whether the engine 12 is turned ON. If the engine 12 is turned OFF, the method 500 returns to step 504. If the engine 12 is turned ON, the control module 40 proceeds to step 506. In step 506, the cam position sensor 36 raises the output signal $V_s$ to a high voltage level when the cam position sensor 36 detects either the leading edge 124*a* or 126*a* of the target wheels 112 or 114, respectively. Preferably, only one of the teeth 124 or 126 is in close proximity to the cam position sensor 36 at a period in time.

In step 508, the control module 40 stores a first time corresponding to the rise in the output signal $V_s$ in memory (e.g. non-volatile memory). In step 510, the cam position sensor 36 drops the output voltage $V_s$ to a low voltage level when the trailing edge 124*b* or 126*b* associated with the detected leading edge in step 502 is detected by the cam position sensor 36. In step 512, the control module 40 stores a second time corresponding to the drop in the output voltage $V_s$. In step 514, the control module 40 determines the identity of the detected target wheel e.g. target wheel 112 or 114) based on a time difference (e.g. PW1 or PW2) between the second time and the first time. In step 516, the control module 40 generates an offset signal (e.g. the offset signal S4-1 or S4-2) based on the time difference.

In step 518, the control module 40 transmits the offset signal to either the cam phaser 32 or 34 corresponding to the detected leading and trailing edges. In step 520, the cam phaser 32 or 34 adjusts the angular offset between the intake camshaft 24 or exhaust camshaft 30, respectively, and the crankshaft. In step 522, the method 500 ends.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A camshaft (cam) phaser control system for an engine, comprising:

a first camshaft having a first target wheel;

a second camshaft having a second target wheel; and a cam position sensor that detects said first and second target wheels and generates an output signal including camshaft position data based on said first and second target wheels, wherein said camshaft position data includes first position data that corresponds to said first target wheel and second position data that corresponds to said second target wheel.

2. The cam phaser control system of claim 1 further comprising a control module that generates a camshaft rotational offset for each of said first target wheel and said second target wheel based on said camshaft position data.

3. The cam phaser control system of claim 2 wherein said first position data includes a first signal pulse and said second position data includes a second signal pulse.

4. The cam phaser control system of claim 3 wherein said first signal pulse has a first pulse width and said second signal pulse has a second pulse width.

5. The cam phaser control system of claim 4 wherein said control module generates said camshaft rotational offsets based on said first and second pulse widths.

6. The cam phaser control system of claim 4 wherein said first pulse width is distinct from said second pulse width.

7. The cam phaser control system of claim 1 wherein said cam position sensor detects said first target wheel during a first period and detects said second target wheel during a second period.

8. The cam phaser control system of claim 1 wherein said cam position sensor detects said first and second target wheels in a radial direction.

9. The cam phaser control system of claim 1 wherein said cam position sensor detects said first and second target wheels in an axial direction.

10. The cam phaser control system of claim 1 wherein said cam position sensor includes first and second position-sensing elements that detect said first target wheel and said second target wheel, respectively.

11. The cam phaser control system of claim 1 wherein said cam position sensor includes a flux deflector that redirects a magnetic field of said cam position sensor towards one of said first target wheel and said second target wheel.

12. A camshaft (cam) phaser control method for an engine, comprising:

detecting a first target wheel of a first camshaft with a first cam position sensor;

detecting a second target wheel of a second camshaft with said first cam position sensor; and generating an output signal including camshaft position data based on said first and second target wheels with said first cam position sensor, wherein said camshaft position data includes first position data that corresponds to said first target wheel and second position data that corresponds to said second target wheel.

13. The method of claim 12 further comprising generating a camshaft rotational offset for each of said first target wheel and said second target wheel based on said camshaft position data.

14. The method of claim 13 wherein said first position data includes a first signal pulse and said second position data includes a second signal pulse.

15. The method of claim 14 wherein said first signal pulse has a first pulse width and said second signal pulse has a second pulse width that is distinct from said first pulse width.

16. The method of claim 15 further comprising generating said camshaft rotational offsets based on said first and second pulse widths.

17. The method of claim 12 wherein said cam position sensor detects said first target wheel during a first period and detects said second target wheel during a second period.

18. A camshaft (cam) phaser control system for an engine, comprising:

a first camshaft having a first target wheel;

a second camshaft having a second target wheel; and a cam position sensor that detects a first rotation of said first target wheel and a second rotation of said second target wheel, and that generates a single output signal in response to said first and second rotations.

19. The cam phaser control system of claim 18 wherein said single output signal includes a first pulse generated in response to said first rotation and a second pulse generated in response to said second rotation.

20. The cam phaser control system of claim 18 wherein said cam position sensor includes a first sensing element that detects said first rotation and a second sensing element that detects said second rotation, wherein said first sensing element outputs a first pulse in response to said first rotation and said second sensing element outputs a second pulse in response to said second rotation, and wherein said single output signal includes said first and second pulses.

* * * * *